United States Patent [19]

Nabinger

[11] Patent Number: 4,773,623

[45] Date of Patent: Sep. 27, 1988

[54] RETRACTABLE HOLDER FOR AN ARTICLE

[75] Inventor: Richard Nabinger, Utica, Mich.

[73] Assignee: The Answer Company, Warren, Mich.

[21] Appl. No.: 33,650

[22] Filed: Apr. 3, 1987

[51] Int. Cl.[4] ..... A47H 1/10

[52] U.S. Cl. ..... 248/330.1; 242/107.4 C; 242/107.6; 248/320; 248/492

[58] Field of Search ..... 248/330.1, 329, 334.1, 248/320, 328, 492; 242/107.6, 107.4 C

[56] References Cited

U.S. PATENT DOCUMENTS

| | | | |
|---|---|---|---|
| 458,769 | 9/1891 | Aldrich | 248/330.1 |
| 727,370 | 2/1903 | Edgerton et al. | 242/107.6 X |
| 870,908 | 11/1907 | Sholes | 242/107.6 |
| 887,689 | 5/1908 | Olop | 242/107.6 X |
| 1,256,016 | 2/1918 | Henderson | 248/330.1 X |
| 1,711,730 | 5/1929 | Gibson . | |
| 4,202,510 | 5/1980 | Stanish | 242/107.6 X |
| 4,556,184 | 12/1985 | O'Sullivan | 248/320 X |

*Primary Examiner*—David L. Talbott
*Attorney, Agent, or Firm*—Basile and Hanlon

[57] ABSTRACT

A retractable holder for an article includes first and second housing members. The first housing member has a first wall and a generally perpendicular peripheral side wall. The second housing member has a second wall generally parallel to the first wall which is engageable with the first housing member to define a hollow inner compartment. A holder is rotatably enclosed within the housing. The holder has a peripheral side wall spaced inwardly from the peripheral side wall of the first housing member. The holder retains a spring to bias the holder in a rotational direction. An attachment member is coiled around the peripheral side wall of the holder and extends externally from the housing for attachment to an article. A locking member engages with the holder to retain the holder against rotational movement after the attachment member has been dispensed to a desired finite length. A clip can be attached to the exterior of the housing for storage of the article when not in use.

11 Claims, 1 Drawing Sheet

RETRACTABLE HOLDER FOR AN ARTICLE

BACKGROUND OF THE INVENTION

1. Field of the Invention

The invention relates to a retractable device for attachment to an article and, more specifically, a retractable device with means for holding the article adjacent the retractable device during storage.

2. Description of the Prior Art

The retractable device is generally used in conjunction with checking fixtures. A check fixture is used to verify that plastic, metal or other material parts conform to drawing specifications. A check fixture utilizes gauge plugs, pins, temps and other loose details to verify part configurations.

These loose details were previously attached to the check fixtures with a thin wire cable. These loose wire cables (approximately 2 feet in length) were always getting tangled, broken or just generally in the way. These loose cables would allow the attached details to slip or fall from fixtures, inadvertently causing the replacement of many lost or damaged details. Thus increasing the number of accurate gauging devices which must be purchased.

It is therefore desirable to provide a retractable holder. This holder can be mounted on the fixture and connected to the details in order to confine the details to the work area. Causing fewer gauging devices to be lost or damaged.

SUMMARY OF THE INVENTION

A retractable holder for an article includes a housing having a hollow inner compartment. The hollow inner compartment is defined by a first wall, a second wall spaced from the first wall and disposed generally parallel to the first wall, and a peripheral side wall disposed generally perpendicular to the first and second walls. The housing encloses and stores flexible means for attaching the article to the housing. The flexible attaching means is extendable externally from the housing. Means for retracting the flexible attachment means is also enclosed with the housing. Preferably, the retractable holder also includes means for locking the retracting means with the flexible attaching means in an extended position, and means, connected to the housing, for holding the article adjacent to the housing for storage.

BRIEF DESCRIPTION OF THE DRAWINGS

In the drawing, like reference numerals refer to the same elements throughout the various views thereof, wherein.

DESCRIPTION OF THE PREFERRED EMBODIMENT

Figure 1:
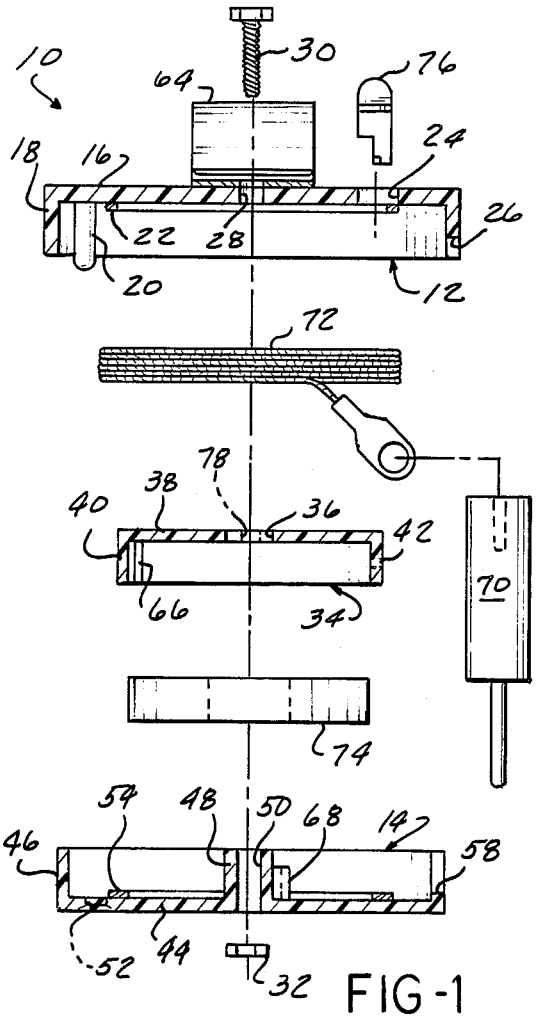
FIG. 1 is an exploded cross sectional view of a retractable holder for an article.
Figure 7:
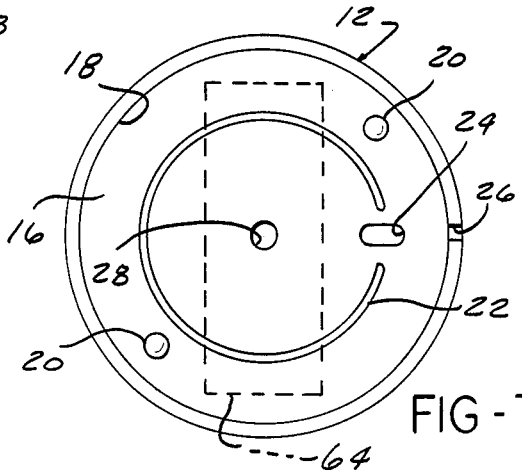
FIG. 7 is a bottom view of the upper housing member.

An exploded cross sectional view of the retractable holder of the present invention is shown in FIG. 1. The housing 10 of the retractable holder includes a first housing member 12, and second housing member 14. The first housing member 12, as shown in FIGS. 1 and 7, includes a first wall 16 and a peripheral side wall 18. The first wall 16 has a first slot 24 spaced inwardly from the peripheral side wall 18. A fastening stud 20 is integrally formed with the first wall 16 of the first housing member 12. A central aperture 28 is also formed in the first wall 16 of the housing 10. A retaining ridge 22 is formed integrally to the first wall 16 of the first housing member 12 which assists in retaining a rotatable holder 34 within the housing 10.

Figure 5:
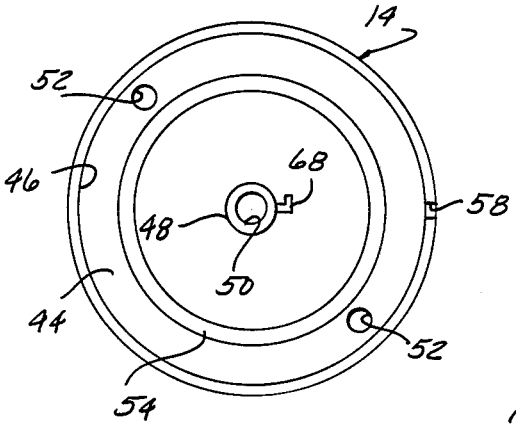
FIG. 5 is a top view of the bottom housing member.

The second housing member 14, as shown in FIGS. 1 and 5, has a second wall 44 disposed generally parallel to the first wall 16 of the first housing member 12. The second housing member 14 also includes a peripheral outer wall 46 and inner wall 48. Preferably, the inner wall 48 can define a central aperture 50 which is aligned with the central aperture 28 in the first wall 16 of the first housing member 12. The central apertures, 28 and 50 respectively, can be used to attach means for holding an article 70, such as a gauge device, adjacent to the housing 10 for storage. The holding means can be a clip 64, such as the spring clip as disclosed in U.S. Pat. No. 1,711,730, a hook, a magnetic, or the like depending on the article 70 to be stored. The central aperture 28 and 50 respectively, can also be used to attach means for mounting the retractable holder in a desired location, such as clip, clamp, or hook for mounting the housing 10 adjacent to the machine apparatus, or for attaching to the belt of the operator. A third slot 58 is formed in the peripheral outer wall 46 of the second housing member 14. When the first housing member 12 is connected to the second housing member 14, the second slot 26 is aligned with the third slot 58 to form an opening through the peripheral side walls, 18 and 46 respectively, to a hollow inner compartment within the housing 10. A second retaining ridge 54, is formed integrally with the second wall 44 of the second housing member 14 and is aligned with the first retaining ridge 22 of the first housing member 12 to retain a rotatable holder 34.

The second housing member 14 includes fastening apertures 52 in the second wall 44. The aperture 52 is aligned with the fastening stud 20 of the first housing member 12, such that the fastening stud 20 will pass through the aperture 52 when the second and third slot, 26 and 58, respectively, are aligned. Preferably, the first and second housing members, 12 and 14 respectively, are constructed of plastic. This permits the fastening stud 20 to be heat staked to hold the first and second housing members together. It should be apparent that other means for securing the first and second housing members, 12 and 14 respectively, are included within the scope of the invention. For examples, the fastening stud 20 can be threaded and a fastening nut can be attached thereto to secure the first housing member 12 to the second housing member 14, or a fastening member, for example a bolt 30 and a nut 32, can be passed through the central apertures, 28 and 50 respectively, to connect the first and second housing members together.

Figure 6:
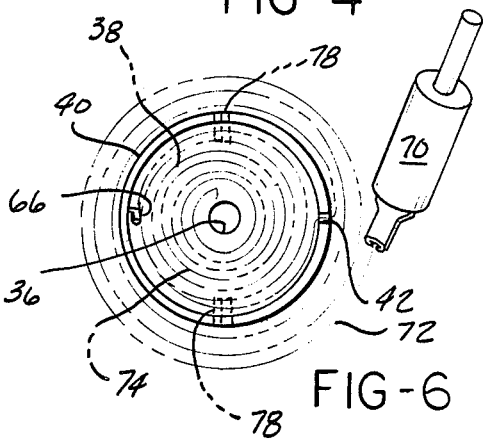
FIG. 6 is a bottom view of the spring holder.

The holder 34, as shown in FIGS. 1 and 6, has a central aperture 36 and is rotatably connected to the inner wall 48 of the second housing member 14. The holder 34 includes a third wall 38 and a peripheral side wall 40. The holder 34 rotates about the inner wall 48 of the second housing member 14 and is retained by the first and second retaining ridges, 22 and 54 respectively, formed on the first and second housing members, 12 and 14 respectively. The third wall 38 is disposed generally parallel to the first and second walls, 16 and 44 respectively, of the housing 10. The third peripheral side wall 40 is disposed generally perpendicular to the first and second walls 16 and 44, respectively. The third peripheral side wall 40 is spaced inwardly from the first and second peripheral sidewalls, 18 and 46 respectively, of the first and second housing members, 12 and 14 respectively.

Flexible means for attaching an article 70 to the housing 10 are provided. The flexible attaching means, is extendable externally from the housing 10 through the second and third slots, 26 and 58 respectively, in the first and second sidewalls, 18 and 46 respectively. The flexible attaching means generally includes an attachment member 72 having a generally circular cross-section and a finite length. The attachment member 72 is anchored at one end to the holder 34 and connected at another end to the article 70. The member attachment 72 is coiled around the third peripheral side wall 40 of the holder 34 for storage within the hollow inner compartment of the housing 10. It should be apparent that attachment member 72 can be selected from a group consisting of a cable, cord, wire, string, rope, filament, fiber, and thread. As shown in FIGS. 1 and 6, the attachment member 72 of the present invention is connected to the holder 34 through an anchoring aperture 42 in the third peripheral side wall 40.

Means for retracting the flexible attaching means are provided within the housing 10. The retracting means can include a coil spring 74 retained within the third peripheral side wall 46 of the holder 34. Suitable spring connections, 66 and 68, are formed on the third peripheral side wall 46 of the holder 34 and the inner wall 48 of the second housing member 14. The coil spring 74, as shown in FIGS. 1 and 6, biases the holder 34 to rotate in an attaching-means-retracting direction.

Figure 2:
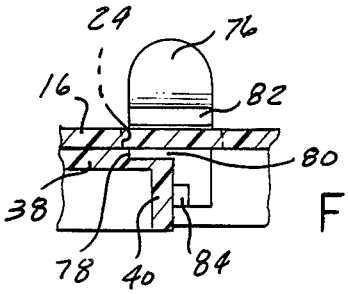
FIG. 2 is a cross sectional detail of a locking means for the retractable holder shown in FIG. 1.
Figure 3:
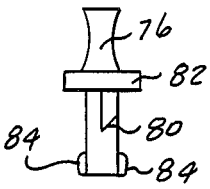
FIG. 3 is a side view of the locking member.
Figure 4:
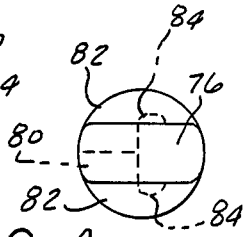
FIG. 4 is a top view of the locking member.

The invention preferably includes means for locking the retracting means with the flexible attaching means extended in a desired position. The locking means can include a locking member 76, as shown in FIGS. 1 through 4. The locking member 76 is disposed in the first slot 24 of the first housing member 12 with one end extending externally to the housing 10 and another end slidingly engaging the third wall and third peripheral side wall, 38 and 40 respectively, of the holder 34. At least one notch 78, shown in FIGS. 1, 2, and 6, is formed in the third wall 38 adjacent the third peripheral side wall 40 of the holder 34. The notch 78 is intermittently disposed adjacent the first slot 24 in the first wall 16 of the first housing member 12 as the holder 34 rotates. An angled edge 80 of the locking member 76 is engageable with the notch 78 in the holder 34 to lock the holder to prevent rotational movement of the holder 34 until the locking member 76 is disengaged from the notch 78. The locking member 76 includes a flared portion 82 external from the housing 10, and a protruding portion 84 within the housing 10 to retain the locking member 76 in the first slot 24 of the first housing member 12.

The first housing member 12 encloses the second housing member 14 with the first peripheral side wall 18 disposed externally of the second peripheral side wall 46, the fastening stud 20 aligned to pass through the fastening aperture 52 in the second housing member 14, and the second slot 26 aligned with the third slot 58 forming an opening from the hollow inner compartment of the housing 10. The holder 34 is rotatably connected to the inner wall 48. A coil spring 74 is retained within the holder 34 and is connected to the third peripheral side wall 40 at one end and the inner wall 48 at another end. The attachment member 72 is anchored to the holder 34 within the housing 10 at one end and attached to an article 70 at another end external to the housing 10. The attachment member 72 passes through the opening defined by the aligned second slot 26 and third slot 58. A finite length of the attachment member 72 is coiled around the third peripheral side wall 40 of the holder 34 and stored within the hollow inner compartment of the housing 10. The article 70 can be removed from the storage clip 64 when needed. The attachment member 72 is pulled out of the housing 10 through the opening defined by the second and third slots, 26 and 58 respectively. As the attachment member 72 is dispensed, the holder 34 rotates which tightens the coil spring 74 through the suitable spring connections, 66 and 68 respectively. As the holder 34 rotates, the locking member 76 slidingly engages the third wall and third peripheral side wall 38 and 40 respectively. When the desired length of attachment member 72 has been dispensed, the rotational velocity of the holder 34 slows, thereby permitting locking member 76 to engage within notch 78 to restrain the holder 34 against further rotation in either direction. When it is desired to retract the attachment member 72, the locking member 76 can be disengaged by pulling upward on the locking member 76, or by pulling out a small additional length of attachment member 72, the locking member 76 will be disengaged from notch 78 and the dispensed length of attachment member 72 can be retracted into its stored position coiled around the third peripheral side wall 40 of the holder 34 within the hollow inner compartment of the housing 10.

Various modifications to the form and construction of the retractable holder may be resorted to without departing from the spirit of the invention disclosed herein.

What is claimed is:

1. A retractable holder for an article comprising:

a housing having a hollow inner compartment defined by a first wall, a second wall disposed spaced from and generally parallel to said first wall and a peripheral side wall generally perpendicular to said first and second walls, said housing having a centrally disposed post with a longitudinal axis perpendicular to said first and second walls, and a slot in said first wall spaced inwardly from said peripheral side wall;

flexible means, stored within said hollow inner compartment of said housing, for attaching an article to said housing, said flexible attaching means extendable externally from said housing;

a holder enclosed within said hollow inner compartment of said housing, for retracting said flexible attaching means and for storing said flexible attaching means within said housing, said holder rotatable about said longitudinal axis of said post and having a retaining wall disposed generally perpendicular to said first and second walls of said housing, said retaining wall having an interior surface and an exterior surface and a notch formed thereon, said notch intermittently disposed adjacent said slot in said first wall of said housing as said holder rotates;

a coil spring enclosed within said retaining wall of said holder, said coil spring attached to said interior surface of said retaining wall at one end and attached to said post at another end to bias said holder in a rotational-attaching-means-retracting direction;

said flexible attaching means anchored to said retaining wall and coiled around said exterior surface of said holder for storage; and a locking member for locking the holder with said flexible attaching means in an extended position, said locking member having one end extending externally from said first wall through said slot and another end slidingly engaging said retaining wall of said holder, said locking member being movable in a plane perpendicular to said first wall and intermittently engageable with said notch on said retaining wall.

2. The retractable holder of claim 1, further comprising:

said housing having a first housing member including said first wall and said peripheral sidewall, and a second housing member including said second wall; and means for securing said first housing member to said second housing member.

3. The retractable holder of claim 2, wherein said securing means further comprises:

said first housing member having a fastening stud integrally formed with said first wall and spaced inwardly from said peripheral side wall; and said second housing member having an aperture in said second wall aligned with said fastening stud for engagement of said fastening stud through said aperture, wherein said fastening stud is heat staked to said second housing member to secure said first housing member to said second housing member.

4. The retractable holder of claim 1, wherein the flexible attaching means further comprises:

an attachment member having a generally circular cross-section and a finite length, said attachment member anchored to said retaining wall at one end and to said article at another end, said attachment member selected from a group consisting of a cord, wire, string, rope, cable, filament, fiber, and thread.

5. The retractable holder of claim 1, further comprising:

means, connected to said housing, for holding said article adjacent to said housing.

6. The retractable holder of claim 5, wherein the holding means further comprises:

a clip affixed to said housing and adapted to releaseably retain said article adjacent said housing for storage.

7. A retractable holder for an article comprising:

a housing having a hollow inner compartment defined by a first wall, a second wall disposed spaced from said first wall and generally parallel to said first wall and a peripheral side wall generally perpendicular to said first and second walls, said housing having a centrally disposed post with a longitudinal axis generally perpendicular to said first and second wall, and further having first slot in said first wall spaced inwardly from said peripheral side wall and a second slot in said peripheral side wall;

a holder rotatably attached to said post for rotational movement about said longitudinal axis and enclosed within said hollow compartment of said housing, said holder having a peripheral side wall disposed adjacent said first slot and generally perpendicular to said first and second walls of said housing, said peripheral side wall of said holder having a notch intermittently disposed adjacent said first slot as said holder rotates;

a coil spring enclosed within said hollow inner compartment of said housing and confined within said peripheral side wall of said holder, with one end of said coil connected to said peripheral side wall of said holder and another end of said coil spring connected to said post to bias said holder in a rotational direction;

a locking member having one end extending externally from said first wall through said first slot and another end slidingly engaging said peripheral side wall of said holder and being movable in a plane perpendicular to said first wall and intermittently engageable with said notch on said holder to lock said holder against rotational movement; and flexible and extendable means for attaching an article to said housing, one end of said attaching means anchored to said holder, a portion of said attaching means adjacent said one end coiled around said holder, another portion of said attaching means extending externally from said housing through said second slot in said peripheral wall of said housing, and another end of said attaching means connected to said article.

8. The retractable holder of claim 7, further comprising means, connected to said housing, for holding said article adjacent to said housing.

9. The retractable holder of claim 8, wherein said holding means further comprises:

a clip affixed to the housing and adapted to releasably retain said article adjacent to said housing for storage.

10. The retractable holder of claim 7, wherein said attachment means further comprises:

an attachment member having a generally circular cross-section and a finite length, said attachment member selected from a group consisting of a cord, wire, string, rope, cable, filament, fiber, and thread.

11. A retractable holder for an article comprising:

a first housing member having a first wall, a peripheral side wall, a fastening stud integral with said first wall and spaced from said peripheral side wall, a first slot disposed in said first wall spaced inwardly from said peripheral side wall, a second slot disposed in said peripheral side wall, and a centrally located aperture;

a second housing member having a second wall, a peripheral outer side wall, an inner sidewall defining a centrally located aperture, a third slot disposed in said peripheral outer side wall and an aperture in said second wall spaced inwardly from said peripheral outer side wall and aligned to receive said fastening stud when said second and third slots are aligned, wherein said first housing member engages with said second housing member to define an inner hollow compartment between said first wall, said second wall, and said peripheral outer side wall, said fastening stud passing through said aperture in said second wall for fastening said first housing member to said second housing member;

a holder rotatably connected to said inner side wall and enclosed within said hollow inner compartment, said holder having a third wall disposed generally parallel to said first and second walls, a peripheral side wall, and a notch disposed in said third wall adjacent said peripheral side wall, said notch intermittently adjacent said first slot in said first wall as said holder rotates;

a coil spring retained within said peripheral side wall of said holder, said coil spring attached at one end to said inner side wall of said second housing member and attached at another end to said peripheral side wall of said holder to bias said holder to rotate in a retracting direction;

a flexible attachment member, having a generally circular cross-section and a finite length, coiled around said peripheral side wall of said holder with one end anchored to said peripheral side wall of said holder and another end, extending externally from said housing through said first and second aligned slots, connected to an article;

a locking member having one end extending externally from said first housing member through said first slot with a flared portion external to said first wall and another end having an elongated portion slidingly engaging said peripheral side wall of said holder with protruding projections to retain said locking member within said first slot between said flared portion and said protruding projections, while allowing movement of said locking member outwardly and inwardly with respect to said first wall, said locking member being movable in a plane perpendicular to said first wall, said elongated portion having an angled surface slidingly engaging said third wall of said holder for locking engagement with said notch in said third wall of said holder to permit locking said attachment member in a desired extended position, said locking member disengageable by outward movement of said locking member with the respect to said first wall; and a clip connected to said housing for holding said article adjacent said housing for storage.

* * * * *